US010126015B2

(12) United States Patent
Garloch et al.

(10) Patent No.: US 10,126,015 B2
(45) Date of Patent: Nov. 13, 2018

(54) INWARD FIRED PRE-MIX BURNERS WITH CARRYOVER

(71) Applicant: Carrier Corporation, Farmington, CT (US)

(72) Inventors: Duane D. Garloch, Westfield, IN (US); Robert Shaw, Indianapolis, IN (US); Larry D. Rieke, Zionsville, IN (US)

(73) Assignee: CARRIER CORPORATION, Farmington, CT (US)

( * ) Notice: Subject to any disclaimer, the term of this patent is extended or adjusted under 35 U.S.C. 154(b) by 337 days.

(21) Appl. No.: 14/938,417

(22) Filed: Nov. 11, 2015

(65) Prior Publication Data

US 2016/0178236 A1 Jun. 23, 2016

Related U.S. Application Data

(60) Provisional application No. 62/094,826, filed on Dec. 19, 2014.

(51) Int. Cl.

| | |
|---|---|
| ***F23D 14/14*** | (2006.01) |
| ***F24H 3/06*** | (2006.01) |
| ***F24H 3/00*** | (2006.01) |
| ***F24H 9/20*** | (2006.01) |

(52) U.S. Cl.

CPC ..... *F24H 3/065* (2013.01); *F23D 14/14* (2013.01); *F24H 3/00* (2013.01); *F24H 9/2085* (2013.01); *F23D 2900/00019* (2013.01)

(58) Field of Classification Search

CPC ..... F24H 9/2085; F23D 14/14

USPC ..... 431/329, 42; 126/116 R, 110 R

See application file for complete search history.

(56) References Cited

U.S. PATENT DOCUMENTS

| | | | | |
|---|---|---|---|---|
| 2,808,047 | A * | 10/1957 | Jaye | F24H 3/105 126/110 R |
| 3,638,636 | A * | 2/1972 | Marshall | F24H 3/105 126/110 R |
| 4,938,283 | A * | 7/1990 | Wood | F23C 5/00 126/104 R |
| 5,359,989 | A * | 11/1994 | Chase | F24H 3/105 126/110 R |
| 8,033,254 | B2 | 10/2011 | Hannum et al. | |
| 8,075,305 | B2 | 12/2011 | Stephens et al. | |
| 8,113,821 | B2 | 2/2012 | Feese et al. | |
| 8,118,588 | B2 | 2/2012 | Lifshits | |
| 8,167,610 | B2 | 5/2012 | Raleigh et al. | |
| 8,206,147 | B2 | 6/2012 | Videto et al. | |

(Continued)

FOREIGN PATENT DOCUMENTS

| | | |
|---|---|---|
| CN | 101142447 B | 4/2013 |
| CN | 203068519 U | 7/2013 |

(Continued)

*Primary Examiner* — Avinash Savani

(74) *Attorney, Agent, or Firm* — Cantor Colburn LLP

(57) ABSTRACT

A burner assembly for a gas furnace including a partition panel including an upstream side, a downstream side, at least two partition openings, and an intermediate transverse slot in communication with each of the at least two partition openings, wherein each partition opening is located adjacent to one another, and at least two burners configured to fire inward, the at least two burners operably coupled to the upstream side, wherein each burner is substantially aligned with each respective partition opening.

12 Claims, 3 Drawing Sheets

(56) References Cited

U.S. PATENT DOCUMENTS

| | | | | |
|---|---|---|---|---|
| 8,375,721 | B2 | 2/2013 | Wilbraham | |
| 8,485,813 | B2 | 7/2013 | Feese et al. | |
| 8,512,033 | B2 | 8/2013 | D'Agostini et al. | |
| 8,528,334 | B2 | 9/2013 | Dutta et al. | |
| 8,662,887 | B2 | 3/2014 | Cain et al. | |
| 8,689,707 | B2 | 4/2014 | Marx et al. | |
| 8,708,693 | B2 | 4/2014 | Astesiano et al. | |
| 8,784,096 | B2 | 7/2014 | Mosiewicz | |
| 2011/0311924 | A1 | 12/2011 | Proscia et al. | |
| 2012/0037053 | A1 | 2/2012 | Gminder et al. | |
| 2012/0148963 | A1 | 6/2012 | Carey et al. | |
| 2012/0152158 | A1 | 6/2012 | Matsumoto et al. | |
| 2012/0178032 | A1 | 7/2012 | Roy et al. | |
| 2012/0247444 | A1* | 10/2012 | Sherrow | F24H 9/14 126/116 R |
| 2013/0006506 | A1 | 1/2013 | Takada et al. | |
| 2013/0091852 | A1 | 4/2013 | Wood et al. | |
| 2013/0260323 | A1 | 10/2013 | Hong et al. | |
| 2014/0004469 | A1 | 1/2014 | Recourt et al. | |
| 2014/0076209 | A1 | 3/2014 | Benum et al. | |
| 2014/0080072 | A1 | 3/2014 | Smirnov et al. | |
| 2014/0272736 | A1 | 9/2014 | Robertson et al. | |

FOREIGN PATENT DOCUMENTS

| | | | |
|---|---|---|---|
| CN | 203464279 | U | 3/2014 |
| CN | 203642174 | U | 6/2014 |
| DE | 102007030269 | A1 | 1/2009 |
| EP | 1685350 | B1 | 7/2012 |
| EP | 2671634 | A1 | 12/2013 |
| JP | 2011202879 | A | 10/2011 |
| JP | 5604222 | B2 | 10/2014 |
| KR | 101102062 | B1 | 1/2012 |
| KR | 101247620 | B1 | 4/2013 |
| KR | 101324945 | B1 | 11/2013 |
| WO | 2014116970 | A3 | 9/2014 |

* cited by examiner

INWARD FIRED PRE-MIX BURNERS WITH CARRYOVER

CROSS REFERENCE TO RELATED APPLICATIONS

The present application is related to, and claims the priority benefit of, U.S. Provisional Patent Application Ser. No. 62/094,826 filed Dec. 19, 2014, the contents of which are hereby incorporated in their entirety into the present disclosure.

TECHNICAL FIELD OF THE DISCLOSED EMBODIMENTS

The presently disclosed embodiments generally relate to burner assemblies in use with heat exchangers and more particularly, to an inward fired pre-mix burners with carryover.

BACKGROUND OF THE DISCLOSED EMBODIMENTS

Generally, burner assemblies used for reduce NOx emissions are premix burners that are fired directly towards the inlets of a heat exchanger. Usually the use of premix burners requires separate ignition and flame sensing for each burner within the assembly. Moreover, to provide sufficient capacity, the surface area facing the cell panel for non-inward fired premix burners needs to be significantly larger than the inlets of the heat exchanger. As a result, the surface temperature of the cell panel is increased significantly during operation; thus, leading to potential early failures of the heat exchanger. There is therefore a need for a burner assembly that reduces the surface temperature of the cell panel.

SUMMARY OF THE DISCLOSED EMBODIMENTS

In one aspect, a burner assembly for a heating appliance is provided. The burner assembly includes a partition assembly including a partition panel, the partition panel including an upstream side, a downstream side, at least two partition openings, and an intermediate traverse slot in communication with each of the at least two partition openings, wherein each partition opening is located adjacent to one another. In one embodiment, the partition panel further includes a first traverse slot in communication with the first of the at least two partition openings, and a last traverse slot in communication with the last of the at least two partition openings. In one embodiment, the partition panel further includes a screen operably coupled to the downstream side. The partition assembly further includes at least two burners operably coupled to the upstream side of the partition panel, wherein each burner is substantially aligned with each respective partition opening.

In one embodiment, the burner assembly further includes a combustion chamber operably coupled to the downstream side of the partition panel. The combustion chamber includes at least two chamber openings disposed therein, wherein each chamber opening is substantially aligned with each respective partition opening. The combustion chamber further includes an igniter, and a flame sensor disposed therein. In one embodiment, the igniter is disposed adjacent to the first transverse slot, and the flame sensor is disposed adjacent to the last transverse slot. In one embodiment, the igniter may be disposed adjacent to a first of the at least two burners or a last of the at least two burners, and the flame sensor may be disposed adjacent to the first of the at least two burners or the last of the at least two burners.

The burner assembly further includes a mixture distribution box including an upstream wall and opposing side walls to form a cavity therein. The mixture distribution box is operably coupled to the upstream side such that the at least two burners are disposed within the cavity. The burner assembly further includes a mixing tube, including a mixing tube aperture, operably coupled to the mixture distribution box. An orifice is operably coupled to the mixing tube, and the valve is operably coupled to the orifice.

In one aspect, a gas furnace is provided. The gas furnace includes a heat exchanger including at least two heat exchanger inlets, and a burner assembly operably coupled to the heat exchanger. The burner assembly includes a partition assembly, including, a partition panel including an upstream side, a downstream side, at least two partition openings, and an intermediate transverse slot in communication with each of the at least two partition openings, wherein each partition opening is located adjacent to one another other, and at least two burners configured to fire inward, the at least two burners operably coupled to the upstream side, wherein each burner is substantially aligned with each respective partition opening and each respective heat exchanger inlets. In one embodiment, the at least two burners are composed from a woven material configured to be selectively permeated by an air-fuel mixture.

In one embodiment, the gas furnace further includes a combustion chamber including at least two chamber openings, an igniter and a flame sensor disposed therein, the combustion chamber operably coupled to the downstream side, wherein each chamber opening is substantially aligned with each respective partition opening, a mixture distribution box including an upstream wall and opposing side walls to form a cavity therein, wherein the mixture distribution box is operably coupled to the upstream side such that the at least two burners are disposed within the cavity, a mixing tube operably coupled to the mixture distribution box, an orifice operable coupled to the mixing tube, and a valve operably coupled to the orifice.

In one embodiment, wherein the partition panel further includes a first transverse slot in communication with the first of the at least two partition openings and a last transverse slot in communication with the last of the at least two partition openings. In one embodiment, the partition panel further includes a woven material covering the first transverse slot, each intermediate transverse slot, and the last transverse slot.

In one embodiment, the igniter is disposed adjacent to the first transverse slot, and the flame sensor is located adjacent to the last transverse slot. In one embodiment, the igniter is disposed adjacent to a first burner of the at least two burners, and the flame sensor is located adjacent to a last of the at least two burners.

BRIEF DESCRIPTION OF THE DRAWINGS

The embodiments and other features, advantages and disclosures contained herein, and the manner of attaining them, will become apparent and the present disclosure will be better understood by reference to the following description of various exemplary embodiments of the present disclosure taken in conjunction with the accompanying drawings, wherein.

DETAILED DESCRIPTION OF THE DISCLOSED EMBODIMENTS

Figure 1:
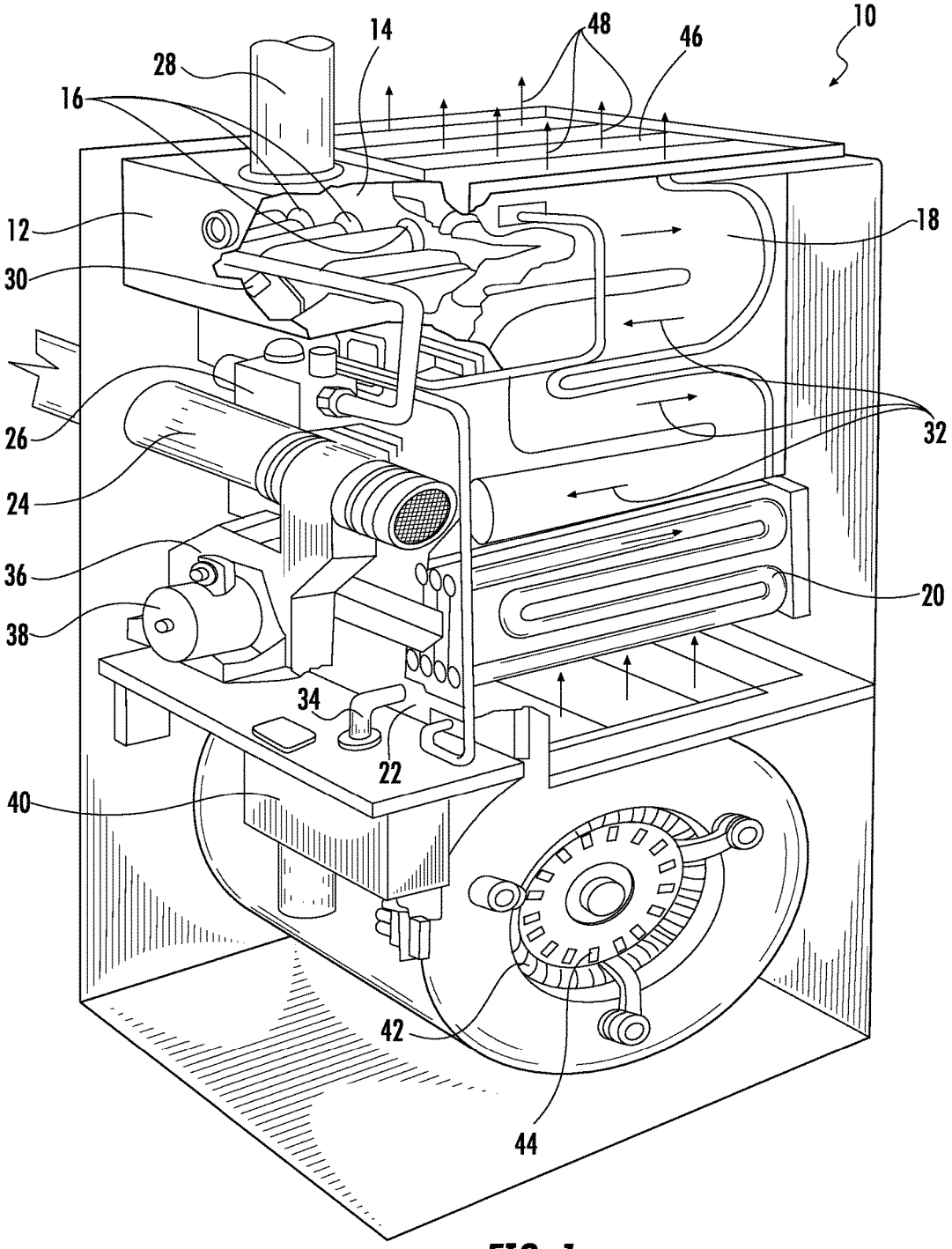
FIG. 1 illustrates a schematic diagram of a gas furnace.

For the purposes of promoting an understanding of the principles of the present disclosure, reference will now be made to the embodiments illustrated in the drawings, and specific language will be used to describe the same. It will nevertheless be understood that no limitation of the scope of this disclosure is thereby intended.

FIG. 1 illustrates a gas furnace 10 which includes a burner assembly 12 with a burner box 14 that is decoupled from the inlets 16 of the primary heat exchanger sections, only one of which can be seen at 18. The primary heat exchanger sections 18 are in fluid communication with corresponding condensing heat exchanger sections 20 whose discharge end is fluidly connected to a collector box 22 and an exhaust vent 24. In operation, a gas valve 26 meters the flow of gas to the burner assembly 12 where combustion air from an air inlet 28 is mixed and ignited by an igniter assembly 30. The hot gas and secondary air are passed through the inlets 16 of the primary heat exchanger sections 18. The primary heat exchanger sections 18 lead to the condensing heat exchanger sections 20, as shown by the arrows 32.

The relatively cool exhaust gases then pass through the collector box 22 and exhaust vent 24 before being vented to the atmosphere, while the condensate flows from the collector box 22 through a drain line 34 for disposal. Flow of combustion air into the air inlet 28 through the heat exchanger sections 18, 20 and the exhaust vent 24 is controlled by an inducer fan 36. The inducer fan 36 is driven by a motor 38 in response to signals from the integrated furnace control or IFC 40. The household air is drawn into a blower 42 which is driven by a drive motor 44, in response to signals received from the IFC 40. The discharge air from the blower 42 passes over the condensing heat exchanger sections 20 and the primary heat exchanger sections 18, in a counter-flow relationship with the hot combustion gases to thereby heat the indoor air, which then flows from the discharge opening 46 in the upward direction as indicated by the arrows 48 to a duct system (not shown) within the space being heated.

Figure 2:
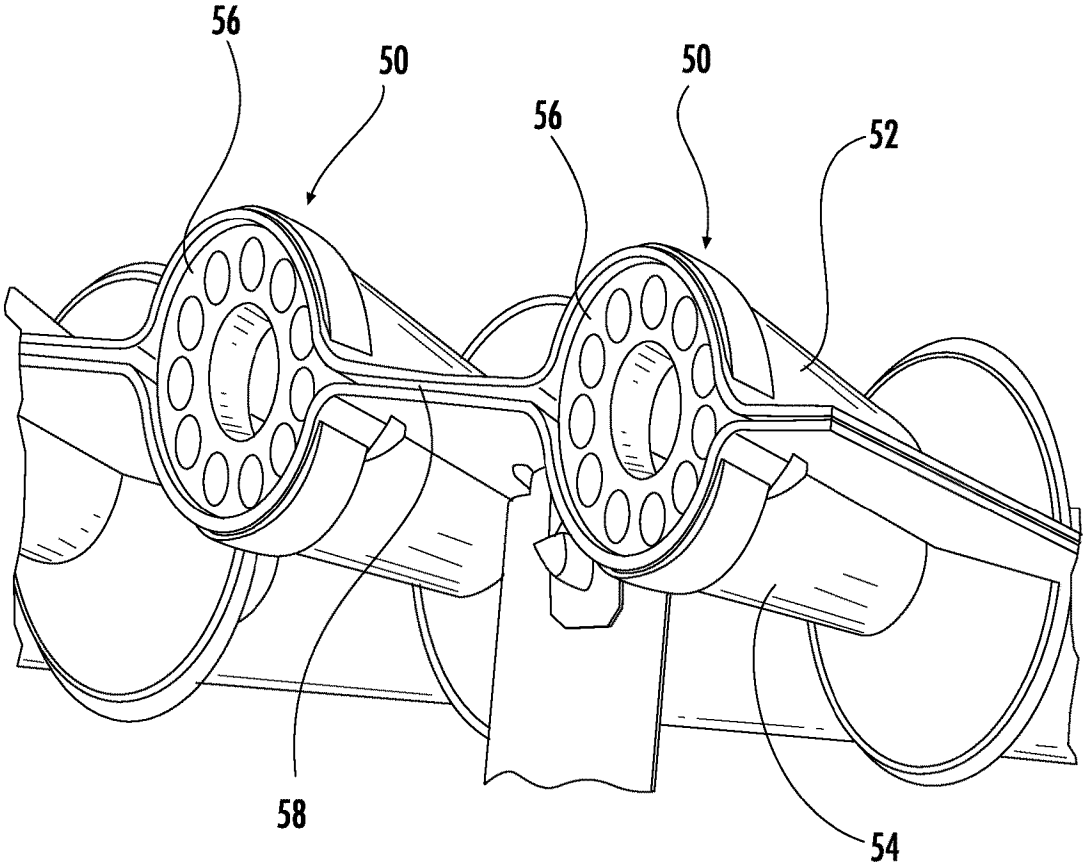
FIG. 2 (PRIOR ART)
FIG. 2 illustrates a schematic diagram of a pair of in-shot burners used in the prior art.

FIG. 2 illustrates a pair of shot burners 50 that are fabricated from two half shells 52, 54. The flame retention devices are illustrated at 56. The half shells 52, 54 provide for a convenient passageway 58 that can be used for flame carryover between the two burners 50. However, such a flame carryover construction is not suitable for low NOx, lean pre-mix burners designed to meet the stringent NOx regulations.

Figure 3:
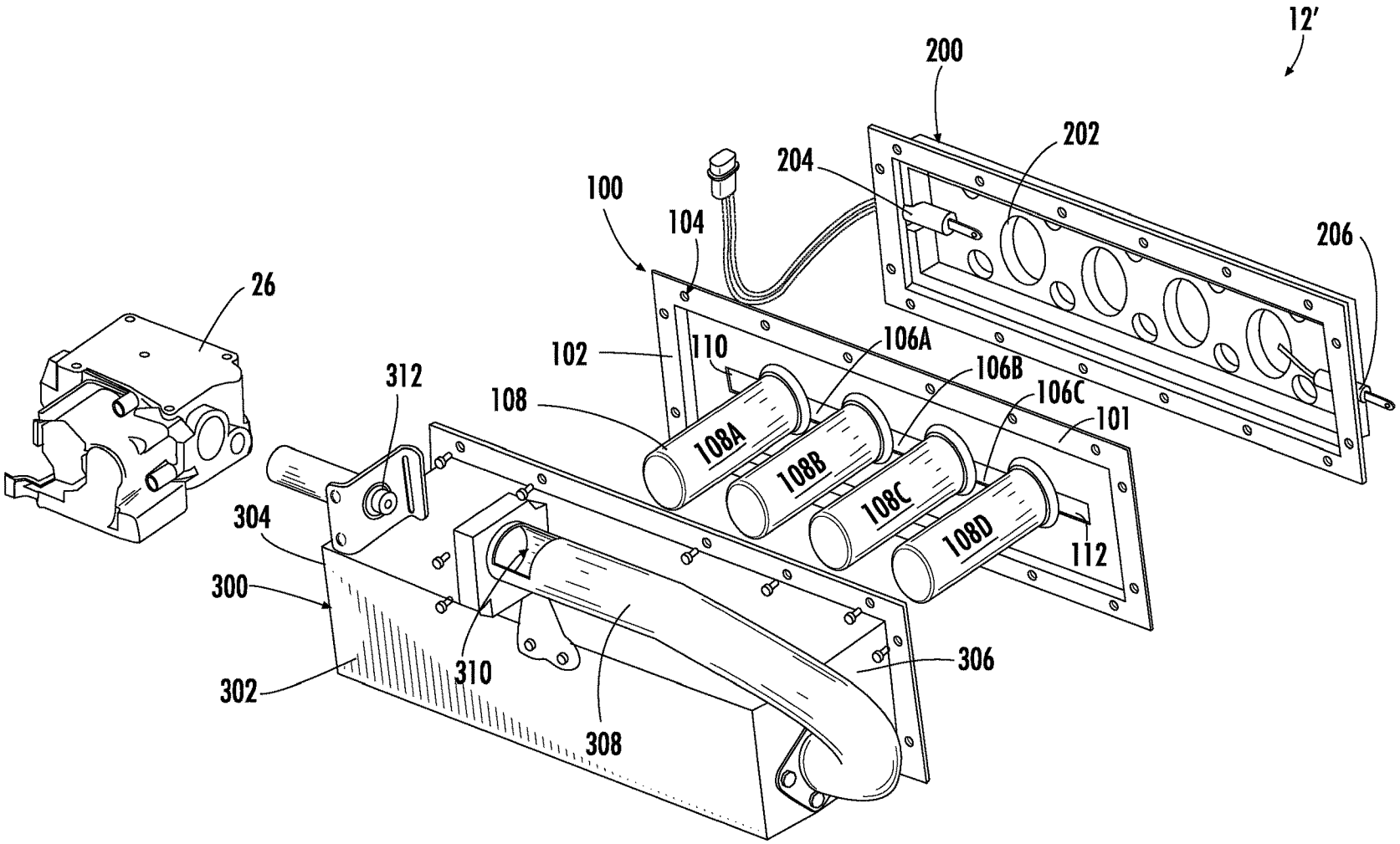
FIG. 3 illustrates a schematic diagram of a burner assembly according to an embodiment of the present disclosure.

FIG. 3 illustrates a burner assembly 12' suitable for meeting the low NOx regulations. The burner assembly 12' includes a partition assembly 100 including a partition panel 101, the partition panel 101 including an upstream side 102, a downstream side 104, at least two partition openings (not shown), and an intermediate traverse slot 106 in communication with each of the at least two partition openings, wherein each partition opening is located adjacent to one another. In one embodiment, the partition panel 101 further includes a first traverse slot 110 in communication with the first of the at least two partition openings, and a last traverse slot 112 in communication with the last of the at least two partition openings. The first transverse slot 110, each of the intermediate transverse slots 106, and the last transverse slot 112 are configured to promote the carryover of a flame during ignition. In one embodiment, the partition panel 101 further includes a screen (not shown) operably coupled to the downstream side 104, wherein the screen is configured to cover the first transverse slot 110, each intermediate transverse slots 106, and the last transverse slot 112. It will be appreciated that the screen may be composed of a woven material, such as woven stainless steel to name one non-limiting example.

The partition assembly 100 further includes at least two burners 108 operably coupled to the upstream side 102 of the partition panel 101, wherein each burner 108 is substantially aligned with each respective partition opening. Each of the at least two burners 108 are configured to fire inward. In one embodiment, each of the at least two burners 108 are composed from a woven material configured to be selectively permeated by an air-fuel mixture.

For example, the partition assembly 100 shown in FIG. 2, includes four burners 108A-D operably coupled to the upstream side 102 of the partition panel 101. The first transverse slot 110 is in communication with the partition opening substantially aligned with burner 108A. Intermediate transverse slot 106A is in communication with the partition openings substantially aligned with burner 108A and burner 108B. Intermediate transverse slot 106B is in communication with the partition openings substantially aligned with burner 108B and burner 108C. Intermediate transverse slot 106C is in communication with the partition openings substantially aligned with burner 108C and burner 108D. The last transverse slot 112 is in communication with the partition opening substantially aligned with burner 108D.

In one embodiment, the burner assembly 12' further includes a combustion chamber 200 operably coupled to the downstream side 104 of the partition panel 101. The combustion chamber 200 includes at least two chamber openings 202 disposed therein, wherein each chamber opening is substantially aligned with each respective partition opening (not shown). The combustion chamber 200 further includes an igniter 204, configured for igniting the air-gas mixture; and a flame sensor 206, configured for detecting the ignition of the at least two burners 108, disposed therein. In one embodiment, the igniter 204 is disposed adjacent to the first transverse slot 110, and the flame sensor 206 is disposed adjacent to the last transverse slot 112. It will be appreciated that the igniter 204 may be disposed adjacent to the last transverse slot 112, and the flame sensor 206 may be disposed adjacent to the first transverse slot 110. In one embodiment, the igniter 204 may be disposed adjacent to the first burner 108A or the last burner 108D, and the flame sensor 206 may be disposed adjacent to the first burner 108A or the last burner 108D.

The burner assembly 12' further includes a mixture distribution box 300 including an upstream wall 302 and opposing side walls 304, 306 to form a cavity (not shown) therein. The mixture distribution box 300 is operably coupled to the upstream side 102 such that the at least two burners 108 are disposed within the cavity.

The burner assembly 12' further includes a mixing tube 308, including a mixing tube aperture 310, operably coupled to the mixture distribution box 300. It will be appreciated that the mixing tube 308 may be coupled to the upstream wall 302, or either of the opposing side walls 304, 306. An orifice 312 is operably coupled to the mixing tube 308, and the valve 26 is operably coupled to the orifice 312. The valve 26 is configured to deliver a fuel, for example natural gas or propane to name a couple of non-limiting examples, through the orifice 312 and into the mixing tube 308.

Referring back to the gas furnace 10 of FIG. 1. The burner assembly 12' operates to replace the burner assembly 12, and the igniter assembly 30. The burner assembly 12' is operably coupled to the primary heat exchanger sections 18, wherein each burner 108 is substantially aligned with each respective heat exchanger inlet. In operation, valve 26 meters the flow of fuel through the orifice 312 into the mixing tube 308. Air enters the mixing tube 308 through the mixing tube aperture 310, where the air is mixed with the fuel within the mixing tube 308 and the air-fuel mixture is delivered to the cavity of the mixture distribution box 300. The air-fuel mixture permeates through each of the burners 108, and into the first transverse slot 110, each intermediate transverse slot 106 and the last transverse slot 112. The air-fuel mixture is then ignited by the igniter 204 positioned adjacent to the first transverse slot 110. After ignition of the first burner 108A, the flame passes though the intermediate transverse slot 106A, then subsequently ignites burner 108B. The flame will continue to pass through the intermediate transverse slots 106, and ignite subsequent burners 108 until the flame reaches the last transverse slot 112. Once the flame reaches the last transverse slot 112, flame sensor 206 sends a signal to the IFC 40 acknowledging that each of the burners have properly ignited. The hot gas burn inward within each of the burners 108 to produce a flame more directed towards the inlets 16 of each primary heat exchanger section 18, as a result reducing the temperature of the cell panel of each primary heat exchanger section 18.

It will therefore be appreciated that the present embodiments includes an inward fired burner 108 to reduce the temperature of each cell panel of each primary heat exchanger section 18. It will also be appreciated that the burner assembly 12' includes a first transverse slot 110 in communication with the first of the at least two partition openings, an intermediate transverse slot 106 in communication with each of the at least two partition openings, and a last transverse slot 112 in communication with the last of the at least two partition openings to allow a flame to pass between each of the burners 108 to reduce the level of NOx produced by the gas furnace 10. It will also be appreciated that each of the transverse slots 106, 110, and 112 allow for a single igniter 204 and a single flame sensor 206; thus reducing the overall cost of the gas furnace 10.

While the invention has been illustrated and described in detail in the drawings and foregoing description, the same is to be considered as illustrative and not restrictive in character, it being understood that only certain embodiments have been shown and described and that all changes and modifications that come within the spirit of the invention are desired to be protected.

What is claimed is:

1. A burner assembly comprising:

a partition assembly, the partition assembly comprising:

a partition panel including an upstream side, a downstream side, at least two partition openings, and an intermediate transverse slot in communication with each of the at least two partition openings, wherein each partition opening is located adjacent to one another, wherein the partition panel further comprises a first transverse slot in communication with the first of the at least two partition openings and a last transverse slot in communication with the last of the at least two partition openings; and at least two burners configured to fire inward, the at least two burners operably coupled to the upstream side, wherein each burner is substantially aligned with each respective partition opening.

2. The burner assembly of claim 1, further comprising:

a combustion chamber including at least two chamber openings, an igniter and a flame sensor disposed therein, the combustion chamber operably coupled to the downstream side, wherein each chamber opening is substantially aligned with each respective partition opening;

a mixture distribution box including an upstream wall and opposing side walls to form a cavity therein, wherein the mixture distribution box is operably coupled to the upstream side such that the at least two burners are disposed within the cavity;

a mixing tube, including a mixing tube aperture, operably coupled to the mixture distribution box; and an orifice operable coupled to the mixing tube.

3. The burner assembly of claim 1, further comprising a screen operably coupled to the downstream side, wherein the screen is configured to cover the first transverse slot, each intermediate transverse slot, and the last transverse slot.

4. The burner assembly of claim 3, wherein the igniter is disposed adjacent to the first transverse slot, and the flame sensor is located adjacent to the last transverse slot.

5. The burner assembly of claim 3, wherein the igniter is disposed adjacent to a first of the at least two burners, and the flame sensor is located adjacent to a last of the at least two burners slot.

6. The burner assembly of claim 1, wherein the at least two burners are composed from a woven material configured to be selectively permeated by an air-fuel mixture.

7. A gas furnace comprising:

a heat exchanger including at least two heat exchanger inlets;

a burner assembly operably coupled to the heat exchanger, the burner assembly comprising:

a partition assembly, the partition assembly comprising:

a partition panel including an upstream side, a downstream side, at least two partition openings, and an intermediate transverse slot in communication with each of the at least two partition openings, wherein each partition opening is located adjacent to one another other, wherein the partition panel further comprises a first transverse slot in communication with the first of the at least two partition openings and a last transverse slot in communication with the last of the at least two partition openings; and at least two burners configured to fire inward, the at least two burners operably coupled to the upstream side;

wherein each burner is substantially aligned with each respective partition opening and each respective heat exchanger inlets.

8. The gas furnace of claim 7, further comprising:

a combustion chamber including at least two chamber openings, an igniter and a flame sensor disposed therein, the combustion chamber operably coupled to the downstream side, wherein each chamber opening is substantially aligned with each respective partition opening;

a mixture distribution box including an upstream wall and opposing side walls to form a cavity therein, wherein the mixture distribution box is operably coupled to the upstream side such that the at least two burners are disposed within the cavity;

a mixing tube operably coupled to the mixture distribution box; an orifice operable coupled to the mixing tube; and a valve operably coupled to the orifice.

9. The gas furnace of claim 7, further comprising a woven material covering the first transverse slot, each intermediate transverse slot, and the last transverse slot.

10. The gas furnace of claim 7, wherein the igniter is disposed adjacent to the first transverse slot, and the flame sensor is located adjacent to the last transverse slot.

11. The gas furnace of claim 7, wherein the at least two burners are composed from a woven material configured to be selectively permeated by an air-fuel mixture.

12. The gas furnace of claim 7, wherein the igniter is disposed adjacent to a first burner of the at least two burners, and the flame sensor is located adjacent to a last of the at least two burners.

* * * * *